United States Patent [19]

Schmohl

[11] 4,266,349

[45] May 12, 1981

[54] CONTINUOUS SOLE FOR SPORTS SHOE

[75] Inventor: Michael W. Schmohl, Nuremberg, Fed. Rep. of Germany

[73] Assignee: Uniroyal GmbH, Aachen, Fed. Rep. of Germany

[21] Appl. No.: 961,915

[22] Filed: Nov. 17, 1978

[30] Foreign Application Priority Data

Nov. 29, 1977 [DE] Fed. Rep. of Germany ..... 2753205

[51] Int. Cl.[3] ..... A43B 13/04; A43C 15/00

[52] U.S. Cl. ..... 36/32 R; 36/59 C; D2/320

[58] Field of Search ..... 36/32, 59 R, 59 A, 59 B, 36/59 C, 25; D2/319, 320, 321

[56] References Cited

U.S. PATENT DOCUMENTS

| | | | |
|---|---|---|---|
| D. 16,757 | 6/1886 | Cowen . | |
| D. 39,747 | 1/1909 | McKenna | D2/320 |
| D. 60,219 | 1/1922 | Delbon | 36/59 C |
| D. 60,561 | 10/1950 | Steinhilber | D2/320 |
| D. 61,017 | 5/1922 | Heilhecker . | |
| D. 86,102 | 2/1932 | Bellows | D2/320 |
| D. 89,204 | 2/1933 | Martin et al. . | |
| D. 201,952 | 8/1965 | Johns . | |
| D. 234,930 | 4/1975 | Arambasic . | |
| 769,324 | 9/1904 | Pratt . | |
| 792,555 | 6/1905 | Pratt . | |
| 825,869 | 7/1906 | Sandeman . | |
| 1,550,772 | 8/1925 | Allan . | |
| 1,568,064 | 1/1926 | Goldman | 36/59 R |
| 1,988,784 | 1/1935 | Carrier | 36/59 C |
| 2,080,680 | 5/1937 | Walther . | |
| 2,244,838 | 6/1941 | Harris . | |
| 2,279,891 | 4/1942 | Maselter . | |
| 2,328,242 | 8/1943 | Witherill . | |
| 2,424,463 | 7/1947 | Hogg . | |
| 2,677,905 | 5/1954 | Dye . | |
| 3,195,244 | 7/1965 | Whitcas . | |
| 3,402,485 | 9/1968 | McMorrow . | |
| 3,583,082 | 6/1971 | Jordan, Jr. . | |
| 3,672,077 | 6/1972 | Coles . | |

FOREIGN PATENT DOCUMENTS

| | | | |
|---|---|---|---|
| 2340940 | 4/1974 | Fed. Rep. of Germany . | |
| 2458576 | 6/1976 | Fed. Rep. of Germany . | |
| 2520796 | 11/1976 | Fed. Rep. of Germany . | |
| 1474358 | 2/1967 | France | 36/59 B |
| 27166 | of 1903 | United Kingdom | 36/59 C |

*Primary Examiner*—James Kee Chi
*Attorney, Agent, or Firm*—Philip Rodman

[57] ABSTRACT

A continuous outsole for a sports shoe has a profile pattern characterized by a first large circular pattern section at the area of the ball of the foot and a second large circular pattern section at the heel area. Each large circular pattern section has a center point that is disposed substantially on a longitudinal dividing line that extends from an end of the toe portion to an end of the heel portion and divides the outsole into two substantially equal longitudinal areas.

18 Claims, 16 Drawing Figures

14
14
15
15
60
60
61
71
59
67
63
62
64
66
65
70
70

CONTINUOUS SOLE FOR SPORTS SHOE

This invention relates to footwear and more particularly to a sports shoe outsole that is continuous from heel to toe and includes generally circular profile pattern elements in the ball and the heel areas of the shoe sole to facilitate rotation of the foot.

It is known in the art to provide the sole of a shoe with a tread profile pattern having depressions that are concentrically oriented at center points respectively located in the area of the sesamoid bone of the forefoot and at the rear outer sole edge of the heel area (Cf. OLS 2,340,940).

The profile elements can be arranged in a plurality of concentric circles that touch one another substantially in the metatarsus area and can be discontinuous along a particular arc. The concentric arrangement of the tread profile pattern has a positive influence on foot movement during walking or running and helps facilitate rotation of the foot in the area of the large ball or heel. It is also known to manufacture the outsole from materials of different Shore A hardnesses in various areas of the sole.

Although known continuous outsoles as described failitate rotatability of the shoe and the foot such profile patterns have been found to cause harmful stressing as well as painful distortions of the foot around the longitudinal axis of the leg when substantial braking or accelerating forces are imposed on the outsole. These forces are transferred from the outsole along the longitudinal direction of the foot and can have a significant adverse effect on the performance of many types of sports activities.

It is thus desirable to provide a continuous outsole for a sports shoe which substantially eliminates harmful stressing and painful distortions of the foot as described without sacrificing rotational facility of the sole when such foot motion is desired.

Among the several objects of the present invention may be noted the provision of an improved continuous outsole for a sports shoe wherein the center points for large respective circles of the tread pattern are situated in the ball and the heel areas of the foot substantially along a longitudinal centerline that divides the sole area approximately in half. Other objects and features will be in part apparent and in part pointed out hereinafter.

According to the invention the longitudinal centerline is not rectilinear but is concavely bent toward the inside of the foot. The centerline originates substantially from the center point of the heel and terminates in the area beyond the second and the third toes.

The invention includes additional profile elements oriented along at least one small circle arranged off-center with respect to the longitudinal centerline of the sole but within the large circle at the ball area of the foot. One or more of the small circles are arranged on or closely adjoining the metatarsal line along the center of the large or small ball of the foot. The metatarsal line is an imaginary line passing through the metatarso-phalangeal joints and running along the inside of the foot through the center of the large ball and, along the outside of the foot, through the center of the small ball. This line is curved in the direction of the transverse arch of the foot with its outline being projected into the plane of the sole as a line that is bent convexly toward the heel. The matatarsal line can also be shown in simplified representation as a straight line connecting the centers of the large and small ball portions in the ball area of the foot. Accordingly, the term metatarsal line is intended to refer to its outline as projected onto the plane of the sole.

Preferably the small rotational circle at the small ball portion of the foot is of a smaller diameter than the small rotational circle at the large ball portion of the foot. If desired small circles at the ball area of the foot can be defined by spot or disc like profile elements at the circle center.

The large circle at the heel area is preferably defined by the outline of the heel area but may also be limited to a spot or disc shaped profile portion at the center of the large heel circle. The profile elements that define the large circle in the heel area may be for example, one quarter, one half or one times the radius of curvature of the outline of the heel.

The two rotational centers in the ball and heel areas are interconnected by the longitudinal centerline of the sole. These pronounced rotational centers with arched profile elements are particularly effective, especially during braking or accelerating in the longitudinal direction or during a wilful rotation, when the components are oriented cross-wise to the longitudinal direction of the foot.

In a preferred embodiment of the sports shoe sole the desired effects are considerably enhanced if the large circle at the ball area is surrounded at the tip of the foot with a partial crown of pronounced profile pattern areas corresponding in number and position to the individual toes. The pronounced profile pattern areas can be formed of spot or disc shaped profile elements or by circular, elliptical or trapezoidal profile element lines arranged concentrically with respect to each other.

A trapezoidal profile pattern area is situated between the two large circle areas at the point of the metatarsus. The trapezoidal profile pattern area at the metatarsus can form a bracing or an abutment for braces arranged in the shoe that provide support and bearing for the longitudinal and transverse arch of the foot. Such a pattern configuration is situated at the outside of the foot and assists in the transfer of braking and accelerating forces along the longitudinal direction of the foot. This force transfer effect is enhanced if the large circle area at the heel has a spot or disc like profile area at the heel center point and the balance of the heel area is provided with profile elements that transmit braking and accelerating forces.

The outsole can extend upwardly toward the upper to form a surrounding edge and then be enclosed by a continuous strip of narrow width. With cast or injection molded shoe soles, the strip preferably extends to a predetermined height of the upper. The heel area includes a circumferential groove of circular cross-section and shallow depth, which increases the elasticity of the heel portion at its junction with the upper.

The invention accordingly, comprises the constructions hereinafter described, the scope of the invention being indicated in the following claims.

In the accompanying drawings in which various possible embodiments of the invention are illustrated, FIG. 1 is a side view of a sports shoe having an outsole embodying the present invention;

Figure 1:
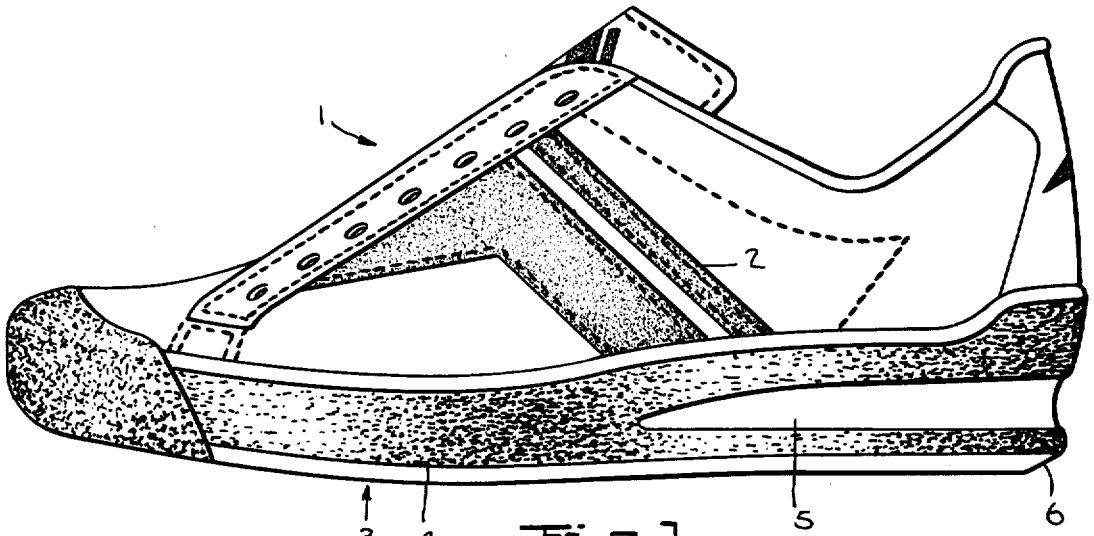
Figure 2:
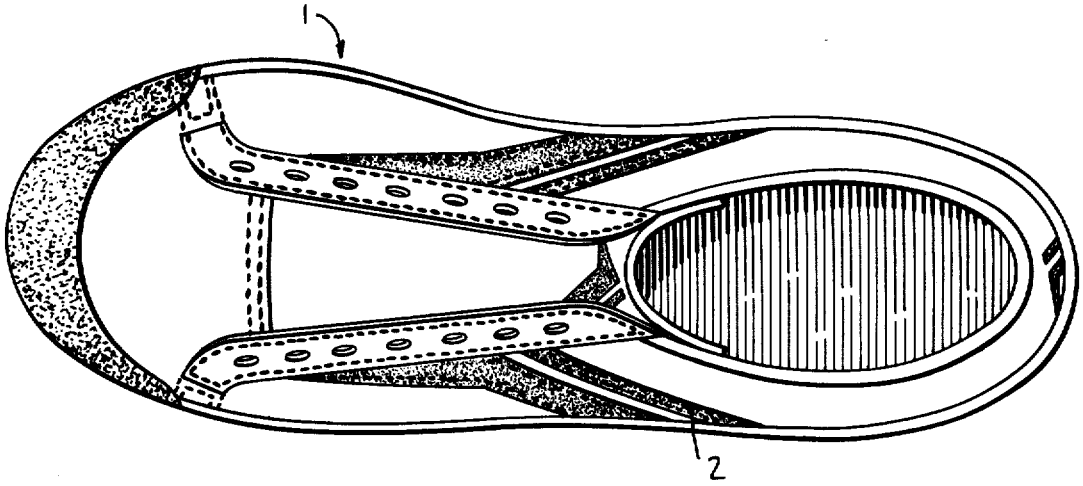
FIG. 2 is a top view thereof.

Referring to the drawings, reference number 1 generally indicates a sports shoe in FIG. 1 having an upper 2 and a sole portion 3. The sole 3, which is made of any suitable material such as rubber, PVC, polyurethane or mixtures thereof, can be separately cast or injection molded directly to the upper. The sole 3 extends upwardly along the lower peripheral edge of the upper and is embraced by a narrow sole edge 4. A partly circular groove 5 is molded into this sole edge 4 in the area of the heel to increase the elasticity of the heel with respect to the upper 2. The rear end of the sole portion 3 is asymmetrically beveled with respect to the longitudinal centerline as indicated by the reference number 6.

Figure 3:
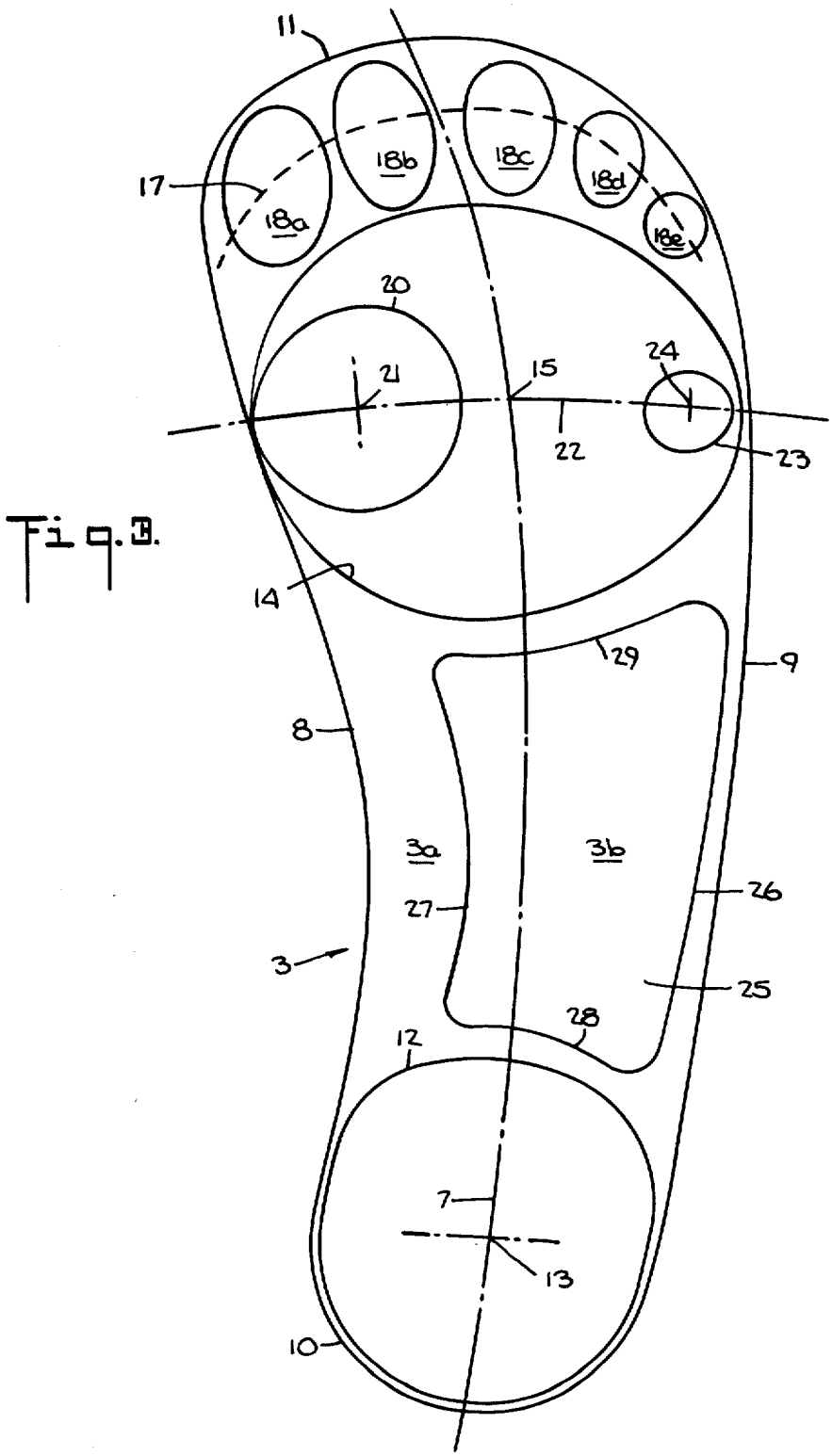
FIG. 3 is a simplified geometric representation of the basic elements of the profile pattern of the outsole.

FIG. 3 shows the sole portion 3 with a profile pattern represented by basic pattern elements in an oversimplified manner. A longitudinal centerline or dividing line 7 subdivides the sole 3 into surface areas 3*a* and 3*b* of substantially identical size. The longitudinal centerline 7 has a concave bend with the concave portion facing an inside portion 8 of the foot. Reference number 9 indicates the outside foot portion, reference number 10 indicates the heel area and reference number 11 indicates the toe area. A projection of the metatarsal line into the step tread plane is generally indicated by reference number 22. The metatarsal line 22 is bent slightly toward the metatarsus area and intersects the longitudinal centerline 7 of the sole at the point 15.

The profile elements are schematically represented in their distribution and orientation by a large circle 12 in the heel area and by a large circle 14 in the ball area. The center point of the large circle 14 lies substantially on the longitudinal centerline 7 at the intersection point 15 and the center of the large circle 12 is essentially at a point 13 of the longitudinal centerline 7. Both large circles 12 and 14 are substantially tangentially inscribed within the area between the longitudinal edges 8 and 9 of the sole portion 3. The radius of curvature of the large circle 12 is determined essentially by the periphery of the heel area 10.

It should be noted that the basic pattern elements of the sole portion 3 can include diverse and differently combined partial patterns.

At a tip 11 of the foot along a curved line 17 the large circle 14 is surrounded by a partial crown of small sized pattern areas 18*a*, 18*b*, 18*c*, 18*d* and 18*e* corresponding in distribution and number to the toes.

One or more small circles representing contours for additional small patterns can be inscribed within the large circle 14 of the ball area. For example, the large circle 14 includes a circle 20 having a center point 21 in the center of the large ball of the foot and a circle 23 of smaller diameter having a center point 24 in the center of the small ball of the foot. The metatarsal line 22 essentially extends through the centers of both balls of the foot and the center points 21 and 24 of the small circles 20 and 23 are both located substantially on the metatarsal line 22.

A distinct profile area pattern 25 defined by a trapezoidal outline is provided in the metatarsal area between the two large circles 12 and 14 disposed toward the outside 9 of the foot. The profile pattern 25 has longitudinal defining lines 26 and 27 extending substantially parallel to the longitudinal centerline 7 of the sole and crosswise defining lines 28, 29 oriented generally concentric to the center points 13 and 15 respectively of the large circles 12 and 14.

The two large circles 12 and 14 constitute major circles of rotation for the heel area and for the area of the ball of the foot. These circles substantially facilitate intentional rotation when the weight is born mainly by the heel or the ball area of the foot. As the center points 13 and 15 of the large circles 12 and 14 are located on the longitudinal centerline 7 the profile elements associated with the large circles transmit the braking or accelerating forces in the longitudinal direction of the foot without twisting the foot around an axis outside the longitudinal centerline. As is well known unintentional off-center twisting of the foot can cause injury, pain or other such discomfort or disability.

The trapezoidal profile pattern in the area of the metatarsus also makes a substantial contribution toward maintaining reliable foot control by transmitting the braking and accelerating forces and permitting absorption and transmission of elevated forces.

The profile pattern areas associated with the individual toes cooperate with the previously described profile patterns in the absorption and transfer of the forces acting upon the sole.

Since a deliberate rotation of the foot is preferably accomplished around the center of the large ball of the foot this rotational function is substantially enhanced with the inclusion of the small circle 20 having corresponding profile elements inscribed within the large circle 14. The metatarsal line 22 connects the small circle 20 to the center 15 of the large circle 14. Thus, the circle 20 does not impair a rotation around the center 15 of the ball area of the foot nor does it prevent a reliable and rotation free absorption and transmission of braking and accelerating forces. This desired balance upon braking and accelerating is further secured with the separate turning circle 23. The circle 23, which is aligned with the center of the small ball of the foot, facilitates rotational movements about the center of the outer ball area as well as the small ball area of the foot.

It should be noted that not all of the elements of the profile pattern need be manifested in a pronounced manner as long as both of the large circles 12 and 14 have their centers substantially aligned with the longitudinal centerline 7 of the sole.

Figure 4:
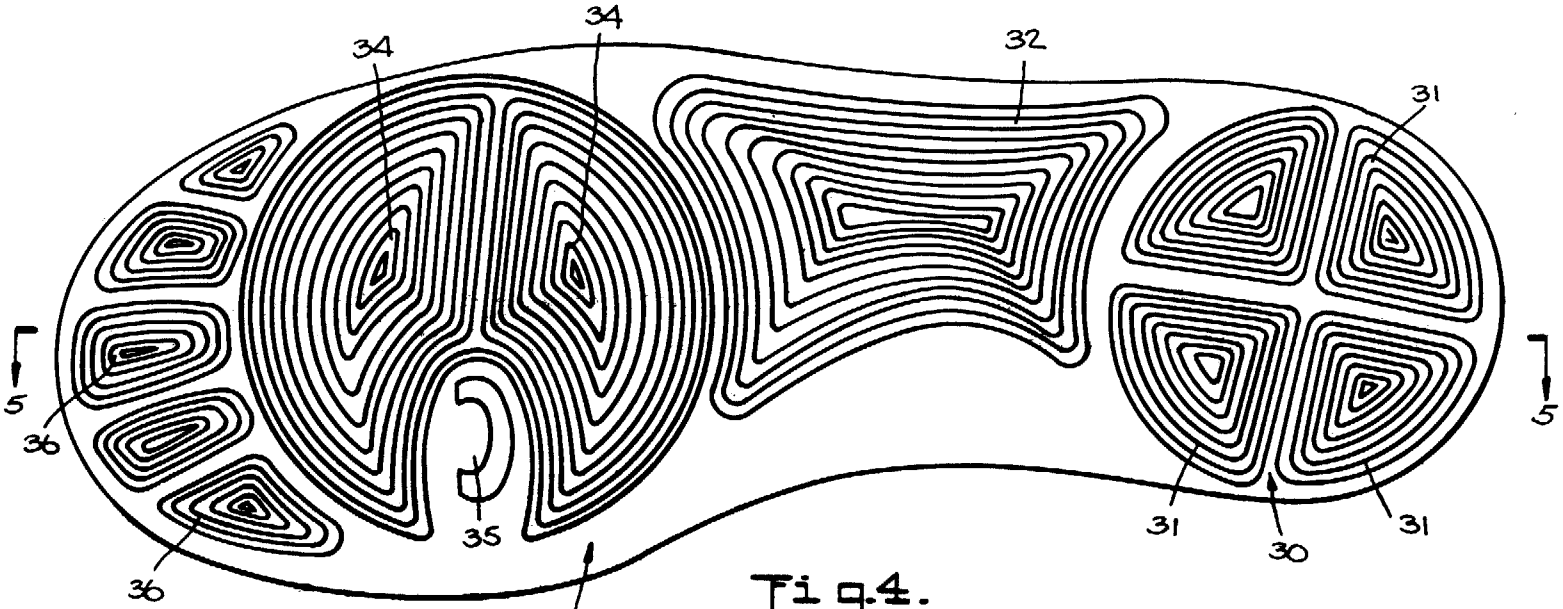
FIG. 4 is a bottom plan view of the outsole.
Figure 5:
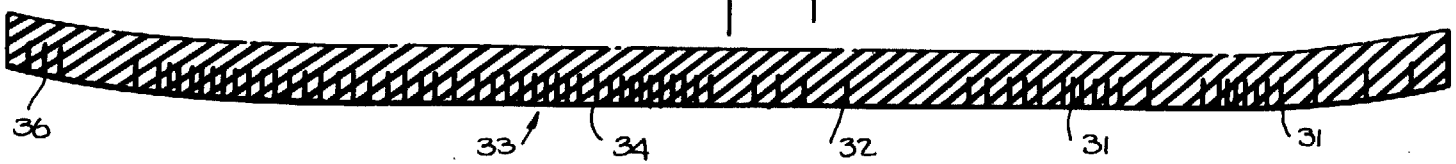
FIG. 5 is a sectional view taken on the line 5—5 of FIG. 4.

The embodiment of FIG. 4 shows a profile pattern structure that is suggested by the basic pattern outline of FIG. 3. Individual base pattern areas use filled out with grooves and profile elevations parallel to or concentric with one another. For example, in a heel area 30 the large circle 12 of FIG. 3 is constituted by four sector-like subareas 31. The subareas 31 have bent arc-like grooves and elevations that facilitate foot rotation. The sections 31 that are oriented crosswise to the longitudinal centerline assist primarily in braking and accelerating. Lateral control of the shoe sole is attributable to the profile elements oriented substantially parallel to the longitudinal centerline. The trapezoidal pattern section 32 in the metatarsal area is instrumental in absorbing the braking and accelerating forces and also provides lateral control.

The large circle in the area 33 of the ball of the foot is constituted by two circular triangular sections 34 substantially symmetrical to the metatarsal line 22 previously shown in FIG. 3. The circular triangular sections 34 define a spot-like plateau 35 having a profile element in the shape of a letter C lying on its back in the area of the large ball of the foot. The toe areas 36 are defined by different shapes such as triangular, elliptical and rounded-off rectangular shapes.

Figure 6:
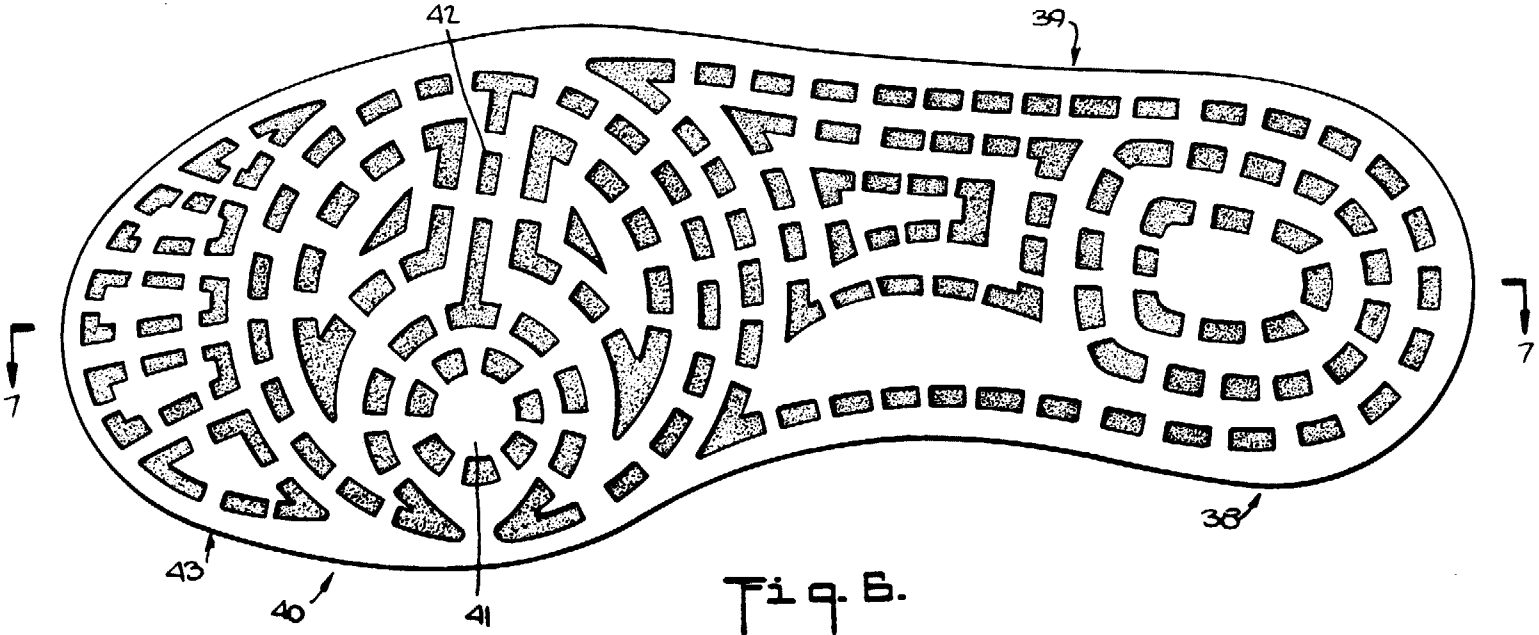
FIGS. 6–16 show various embodiments of the outsole that employ the basic pattern shown in FIG. 3.
Figure 7:
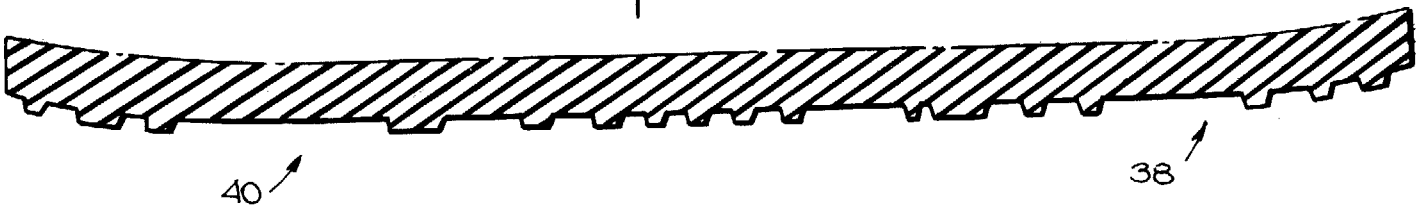

In the embodiment of FIG. 6 spaced blocks simulate the fine line pattern of FIG. 4 and the heel area 38 is no longer sectored. A ball area 40 at the large ball portion of the foot includes a small circular pattern 41. A series of profile elements 42 in the ball area 40 accentuate the metatarsal line. The toe area is indicated by the reference number 43 and the metatarsal area is indicated by the reference number 39. The area remaining along the inside of the foot adjacent the trapezoidal pattern 39 can be used for a trademark designation (not shown).

Figure 8:
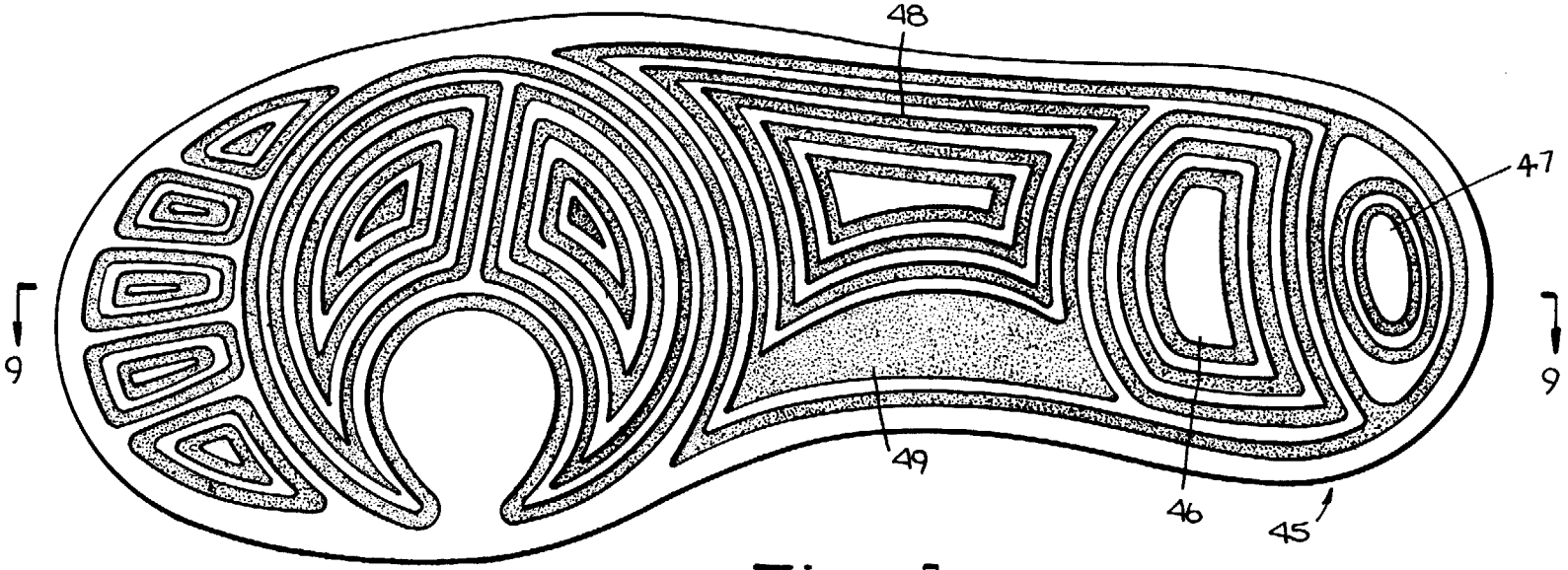
Figure 9:
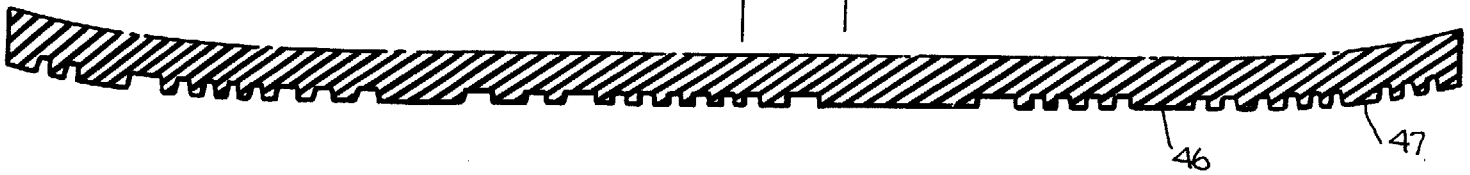

In the FIG. 8 embodiment the profile elements of each profile line are continuous. The large circle in the heel area 45 includes an elliptical profile area 47 and a trapezoidal area 46. The trapezoidal area 48 of the metatarsus has a plateau 49 that can be used for a trademark designation (not shown).

Figure 10:
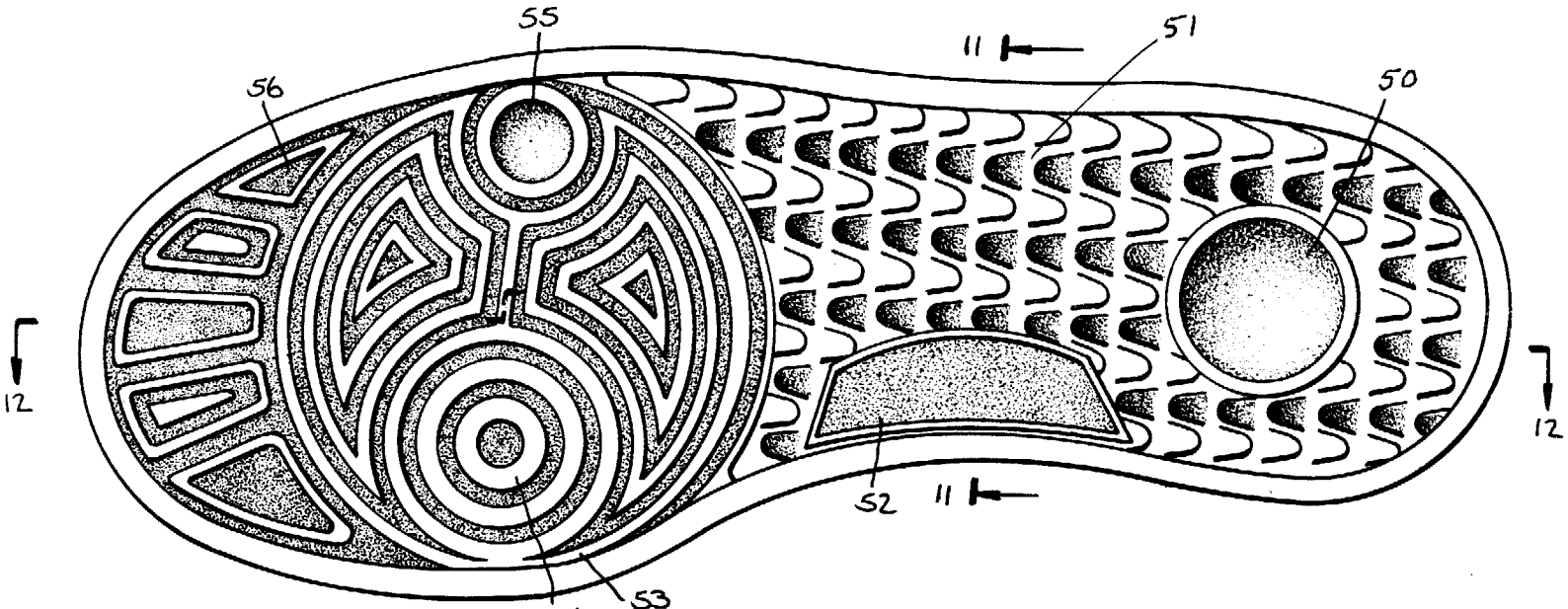
Figure 11:
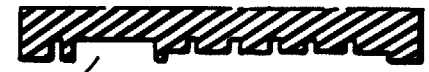
Figure 12:
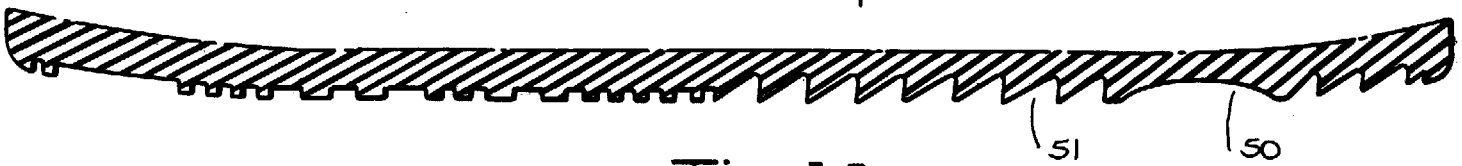

In the embodiment of FIG. 10 the large circle in the heel area includes a disc like profile element 50 disposed at the center of the circle. The balance of the heel area as well as the metatarsal area, with the exception of the block section 52 that is usable for a trademark designation, includes a scale pattern 51. The scale pattern 51 provides good traction particularly in the longitudinal direction of the foot and allows for good lateral control as well. The large circle 53 at the area of the ball of the foot includes a pattern of distinctly different composition from that of the heel and metatarsal areas and has two inscribed small circles 54 and 55 at the large and small ball portions of the foot. Separately defined mini-pattern areas 56 are associated with the toes. The metatarsal line forms an axis that joins the center point of each small circle at the large and small ball areas of the foot with the center point of the pertinent large circle. The area of the forefoot is thus furnished with two or three clearly defined rotational areas that directly cooperate with each other.

Figures 13, 14, 15, 16:
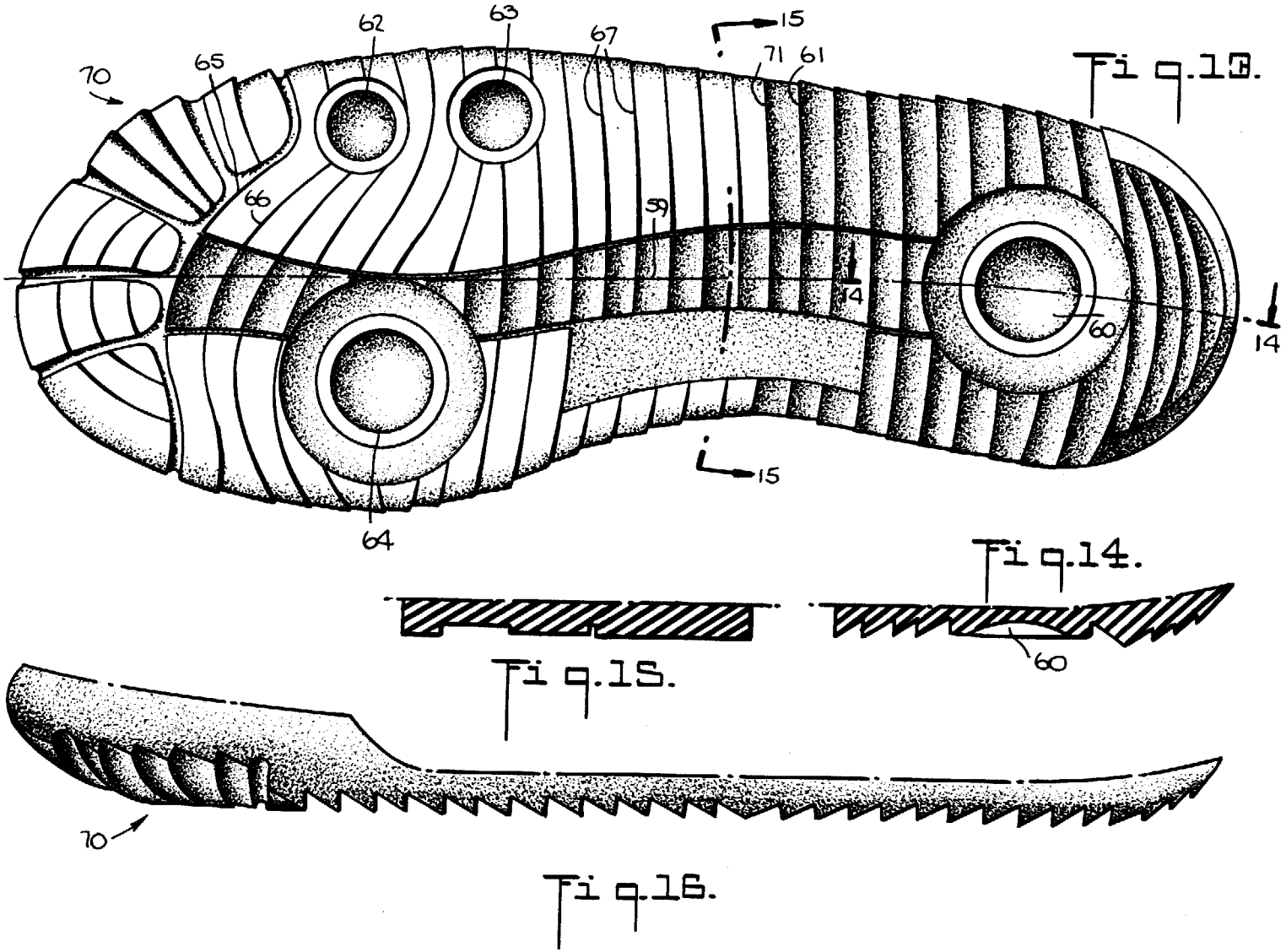

In the embodiment of FIG. 13 small circles 62, 63 and 64 in the ball area of the foot and a circular profile element 60 in the large circle area of the heel are distinctively prominent in the sole pattern. The toe area 70 is provided with differentially bent ribs which attribute functions to the first three toes that are clearly different from those of the two outer toes.

The large circle in the ball area of the foot as shown in FIG. 3 is, in the embodiment of FIG. 13, suggestively defined between the arcuate ribs 65 and 66, and the ribs 67. The reference number 59 indicates the longitudinal dividing line of the sole and the reference number 61, indicates the ribs located in the metatarsal area 71. The sole has a scale like profile pattern having favorable traction properties. At the metatarsal area 71 the steep edges of the ribs are arranged to face in opposite directions so that the heel area is suited for braking while the area of the ball of the foot is particularly suited for accelerating.

Three different rotational areas situated at the ball area of the foot with center points of each rotational area along or closely adjoining the metatarsal line enable the entire forefoot to rotate like a plate whose deepest point is off center under the large ball in the area of the sesamoid bone.

It will be apparent to those skilled in the art that each of the disclosed embodiments incorporate the general framework of the basic pattern of FIG. 3 to provide a continuous outsole effective for different application purposes by utilization of special profiling. Moreover, each one of the raised profile pattern areas such as the large circle, small circle, toe areas or trapezoidal area can be formed out of substantially concentric, circular, elliptical, triangular or trapezoidal configurations.

Some advantages of the present invention evident from the foregoing description include a continuous sportsole wherein the center points of the large circles at the ball and heel areas of the foot are at the longitudinal centerline of the foot. This enables the braking and accelerating forces on the foot and outsole to be safely absorbed and transferred along the longitudinal direction of the foot. This force transfer occurs without producing any torsional forces at the tread profile elements that may lead to painful stresses, twisting an/or distortions of the foot. Consequently, the braking and accelerating forces are efficiently converted to effective use.

Moreover when the profile elements are oriented according to large circles at the ball and heel areas of the foot as described, wilful rotations of the foot around the ball area or the heel area are more easily facilitated. Rotational movement of the foot at the ball area is especially facilitated if a small circle arranged within the large circle is situated at the areas of the large and/or the small ball portions of the foot respectively.

The force transfers and rotational facilities of the sportsole are especially effective if the large circle at the ball area completely encloses the large and small ball portions of the foot and has a center point located at the intersection of the longitudinal center line of the sole and the metatarsal line.

If desired the outsole can be subdivided into areas that are made out of different material. In particular it is possible to manufacture the two large circles out of one type of material whereas the balance of the outsole can be made of another one of the previously described materials.

In view of the above it will be seen that the several objects of the invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

What is claimed is:

1. Footwear having a toe portion and a heel and a continuous outsole from said toe portion to said heel portion, said outsole having a profile pattern comprising a first pattern section in the area of the ball of the foot and a second pattern section in the area of the heel of the foot, said first and second pattern sections being respectively characterized by first and second substantially large circular shapes at the ball and heel areas for facilitating rotation of said foot at said ball and heel areas, said first and second large circular shapes having center points disposed substantially on a longitudinal dividing line extending from an end of said toe portion to an end of said heel portion and dividing said outsole into two substantially equal longitudinal areas, and wherein said first large circular shape encompasses the ball area of the foot and at least one small circular shape, said one small circular shape having a center point disposed on one side of the longitudinal dividing line.

2. The footwear claim 1 wherein said first large circular shape encompasses a second small circular shape, said second small circular shape having a center point disposed on the other side of said longitudinal dividing line.

3. The footwear of claim 2 wherein the center of said first large circular shape is substantially at the center of the ball area of said foot, and a metatarsal line intersects said longitudinal dividing line substantially at the center of said first large circular shape and extends substantially at right angles to said longitudinal dividing line, the centers of said first and said second small circular shapes being disposed substantially on said metatarsal line.

4. The footwear of claim 1 wherein the radius of the second substantially large circular shape is approximately 0.2 to one times the radius of curvature of the heel.

5. The footwear of claim 1 wherein said profile pattern further comprises a third pattern section in a metatarsal area between the first and second pattern sections, said third pattern section being characterized by a substantially trapezoidal shaped pattern having profile elements arranged substantially parallel to said longitudinal dividing line.

6. The footwear of claim 1 wherein said profile pattern further includes a toe pattern section formed in the toe portion of said outsole, said toe pattern section comprising a partial crown to the area of the ball of the foot, of distinct profile pattern areas corresponding in number and position to the individual toes.

7. The footwear of claim 1 wherein the first and second large circular shapes comprise disc shaped profile elements.

8. The footwear of claim 1 wherein at least one of the first and second large circular shapes comprise concentric annular profile elements.

9. The footwear of claim 8 wherein the profile elements of the first and second large circular shapes are formed of broken lines repeated in concentric likenesses.

10. The footwear of claim 3 wherein the first and second small circular shapes comprise disc shaped profile elements.

11. The footwear of claim 3 wherein the first and second small circular comprise concentric annular profile elements.

12. The footwear of claim 11 wherein the profile elements of the first and second small circular shapes are formed of broken lines repeated in concentric likenesses.

13. The footwear of claim 6 wherein the distinct profile pattern areas of said toe pattern section corresponding to the toes each have a separately definable geometric periphery.

14. The footwear of claim 13 wherein the distinct profile pattern areas of said toe pattern section each comprise concentric triangular or trapezoidal shaped profile elements.

15. The footwear of claim 14 wherein the distinct profile elements are formed of broken lines repeated in concentric likenesses.

16. The footwear of claim 1 wherein said second pattern section includes at least one small trapezoidal shaped profile element and at least one small elliptical shaped profile element.

17. The footwear of claim 1 wherein said sole has a peripheral edge and a border strip is provided around said peripheral edge, said border strip including a groove extending around the area of said heel.

18. The footwear of claim 3 wherein the first and second large circular shapes comprise disc shaped profile elements, one of the disc shaped profile elements in the first large circular shape being included in the first small circular shape and another of the disc shaped profile elements in the first large circular shape being included in the second small circular shape.

* * * * *